US012404087B2

(12) United States Patent
Ahmed

(10) Patent No.: US 12,404,087 B2
(45) Date of Patent: Sep. 2, 2025

(54) VERSATILE INSULATION AND SECURE STORAGE SYSTEMS

(71) Applicant: Syed Ahmed, Pearland, TX (US)

(72) Inventor: Syed Ahmed, Pearland, TX (US)

( * ) Notice: Subject to any disclaimer, the term of this patent is extended or adjusted under 35 U.S.C. 154(b) by 13 days.

(21) Appl. No.: 18/501,860

(22) Filed: Nov. 3, 2023

(65) Prior Publication Data

US 2024/0059476 A1 Feb. 22, 2024

Related U.S. Application Data

(63) Continuation-in-part of application No. 17/365,824, filed on Jul. 1, 2021, now abandoned.

(51) Int. Cl.

| | |
|---|---|
| ***B65D 81/38*** | (2006.01) |
| ***A45C 11/18*** | (2006.01) |
| ***A45C 13/10*** | (2006.01) |
| ***A45C 15/06*** | (2006.01) |
| ***A47G 23/02*** | (2006.01) |

(52) U.S. Cl.

CPC ..... *B65D 81/3876* (2013.01); *A45C 11/182* (2013.01); *A45C 13/103* (2013.01); *A45C 13/1076* (2013.01); *A45C 15/06* (2013.01); *A47G 23/0266* (2013.01); *A45C 2011/186* (2013.01); *A45C 2013/1015* (2013.01); *A47G 2023/0275* (2013.01)

(58) Field of Classification Search

CPC . A45C 11/182; A45C 13/103; A45C 13/1076; A45C 15/06; A45C 2011/186; A45C 2013/1015; A47G 23/0266; A47G 2023/0275; B65D 81/3876

USPC ..... 220/737

See application file for complete search history.

(56) References Cited

U.S. PATENT DOCUMENTS

| | | | | | |
|---|---|---|---|---|---|
| 3,085,612 | A * | 4/1963 | Gobel | A61J 9/08 | 383/110 |
| 4,282,279 | A * | 8/1981 | Strickland | B65D 25/34 | 206/139 |
| 4,401,245 | A * | 8/1983 | Zills | B65D 81/3886 | 224/148.6 |
| 5,217,056 | A * | 6/1993 | Ritter | G06K 19/005 | 150/147 |
| 6,029,847 | A * | 2/2000 | Mahoney, Jr. | A45C 11/20 | 220/592.24 |
| 6,161,959 | A * | 12/2000 | Abraham | A44B 19/301 | 24/387 |

(Continued)

*Primary Examiner* — Gideon R Weinerth

(74) *Attorney, Agent, or Firm* — Miller IP Law; Devin Miller

(57) ABSTRACT

Described herein are examples of a versatile insulation and secure storage system including an insulated sleeve, a first pocket, a second pocket, a fastener, and a multifunctional device. The insulated sleeve may be configured to surround and thermally insulate a container. The first pocket may be configured to hold a card a first card vertically within the insulated sleeve, and the second pocket may be configured to hold an identification card or driver's license within the insulated sleeve. The fastener may be configured to provide quick and reliable access to the second pocket. The multifunctional device may be attachable to an outer surface of the insulated sleeve, wherein the multifunctional device comprises various integrated components configured to provide additional functionality to the system.

18 Claims, 7 Drawing Sheets

(56) References Cited

U.S. PATENT DOCUMENTS 6,401,993 B1 * 6/2002 Andrino ..... A45F 5/00 D3/229
D474,887 S * 5/2003 Forster ..... D3/229
D544,312 S * 6/2007 Dill-Schmidt ..... D7/624.3
7,252,213 B1 * 8/2007 DeSanto ..... B65D 81/3886 224/148.7
D630,429 S * 1/2011 Reyes ..... D3/229
D653,445 S * 2/2012 Enghard ..... D3/229
D677,882 S * 3/2013 Inglis ..... D3/229
8,757,427 B2 * 6/2014 Hiner ..... B65D 81/3876 220/737
8,820,367 B2 * 9/2014 Reyes ..... A45F 3/02 206/545
D780,442 S * 3/2017 Tidwell ..... D3/202
9,877,556 B1 * 1/2018 Holder ..... A45C 1/06
10,206,475 B2 * 2/2019 Pusey ..... A45C 15/02
D858,226 S * 9/2019 Escontrela ..... D7/624.2
D885,148 S * 5/2020 Wang ..... D7/624.2
11,382,402 B2 * 7/2022 King ..... B65D 23/12
11,492,175 B2 * 11/2022 Wang ..... B65D 23/0871
D992,363 S * 7/2023 Chiu ..... D3/202
12,022,924 B1 * 7/2024 Liang ..... A45C 1/06
12,096,842 B1 * 9/2024 Yang ..... B65D 25/20
2004/0016058 A1 * 1/2004 Gardiner ..... G01C 17/00 7/164
2004/0216825 A1 * 11/2004 Radochonski ..... A45C 1/06 150/147
2005/0035605 A1 * 2/2005 Vanderwater-Piercy ..... A45C 13/18 292/308
2005/0279751 A1 * 12/2005 Dempsey ..... B65D 81/3876 220/739
2006/0186129 A1 * 8/2006 Allnutt ..... B65D 81/3865 220/737
2007/0068944 A1 * 3/2007 McKinney ..... A45F 3/16 220/256.1
2008/0023114 A1 * 1/2008 Bridgefarmer ..... A45C 11/182 150/132
2010/0243687 A1 * 9/2010 Liang ..... A45C 3/001 224/660
2011/0132507 A1 * 6/2011 Reyes ..... A45F 3/02 150/112
2012/0091156 A1 * 4/2012 Lee ..... B65D 81/3865 220/737
2012/0187138 A1 * 7/2012 Vasquez ..... A45C 15/00 220/739
2013/0001122 A1 * 1/2013 Nowzari ..... B65D 23/085 206/459.5
2013/0098954 A1 * 4/2013 Inglis ..... A45C 1/02 224/148.4
2015/0021346 A1 * 1/2015 Cappuccio ..... A47G 23/02 220/735
2015/0191293 A1 * 7/2015 Forcella ..... A47G 23/0233 220/592.16
2015/0265083 A1 * 9/2015 Myers ..... B65D 25/54 220/737
2016/0214784 A1 * 7/2016 Caldwell ..... A45C 3/00
2016/0368697 A1 * 12/2016 Otero-Palacios .... B65D 25/205
2017/0245624 A1 * 8/2017 Neves ..... A45C 11/32
2017/0262884 A1 * 9/2017 Miller ..... A45C 15/00
2018/0020791 A1 * 1/2018 Cole ..... A45F 3/005 224/576
2018/0153326 A1 * 6/2018 Parinella ..... A47G 23/0266
2018/0257845 A1 * 9/2018 Phelps, III ..... C09J 4/06
2018/0332936 A1 * 11/2018 Serman ..... A45C 11/182
2019/0233197 A1 * 8/2019 Myles ..... A47G 19/12
2020/0085177 A1 * 3/2020 Walk ..... A45C 11/20
2020/0244300 A1 * 7/2020 Wolf ..... A45C 13/02
2021/0085062 A1 * 3/2021 Steele ..... A45F 3/16
2021/0130040 A1 * 5/2021 Sanders ..... D04B 21/20
2021/0244219 A1 * 8/2021 Richard ..... A45F 5/02
2022/0175056 A1 * 6/2022 Pond ..... H04B 1/385
2022/0400836 A1 * 12/2022 Western ..... A45F 3/02
2023/0000270 A1 * 1/2023 Ahmed ..... A47G 23/0216
2023/0255379 A1 * 8/2023 Simerly ..... B65D 81/3876 220/739
2024/0059476 A1 * 2/2024 Ahmed ..... A45C 1/06
2024/0083629 A1 * 3/2024 Abasi ..... B65D 23/0871

* cited by examiner

VERSATILE INSULATION AND SECURE STORAGE SYSTEMS

CROSS-REFERENCE TO RELATED APPLICATIONS

The present application is a continuation of U.S. Non-Provisional patent application Ser. No. 17/365,824 entitled "The Koozie Wallet", filed on Jul. 1, 2021. The entire contents of the above-listed application are hereby incorporated by reference for all purposes.

BACKGROUND

In the domain of personal accessories and multifunctional devices, a distinct field has materialized, centered on redefining the way individuals handle their daily requirements. More precisely, the field of insulation and storage systems has gained prominence for its innovative approach to enhancing user convenience and efficiency. This specialized field is characterized by the integration of beverage holder and wallet functionalities within a single, multifunctional device. This technology caters to the contemporary demand for streamlined and adaptable solutions that simplify everyday tasks.

BRIEF DESCRIPTION OF THE DRAWINGS

The present description will be understood more fully when viewed in conjunction with the accompanying drawings of various examples of a versatile insulation and secure storage system. The description is not meant to limit the versatile insulation and secure storage system to the specific examples. Rather, the specific examples depicted and described are provided for explanation and understanding of the versatile insulation and secure storage system. Throughout the description the drawings may be referred to as drawings, figures, and/or FIGS.

DETAILED DESCRIPTION

Figure 1:
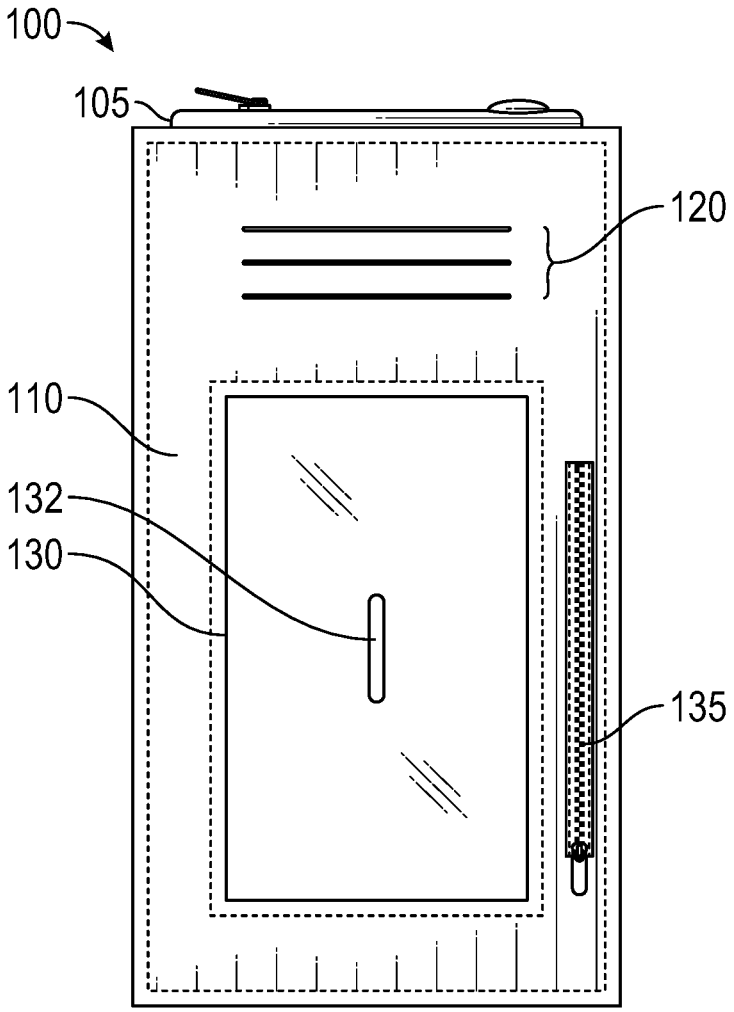
FIG. 1 illustrates a front view of a versatile insulation and secure storage system, according to an embodiment.

A versatile insulation and secure storage system as disclosed herein will become better understood through a review of the following detailed description in conjunction with the figures. The detailed description and figures provide merely examples of the various embodiments of the versatile insulation and secure storage system. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional personal wallet may include separate compartments or cardholders for organizing and storing various cards, such as credit cards, identification cards, and driver's licenses. These wallets are typically made of materials like leather or fabric, with some featuring additional pockets for carrying cash and other essentials. They serve as a standard means for individuals to keep their cards and financial items organized and easily accessible.

However, the current state of conventional personal wallets presents certain challenges. Firstly, they may lack security features, making cards susceptible to unauthorized scanning and potential theft. Additionally, these wallets often do not address the increasing demand for multifunctionality, leaving opportunities untapped for integrating supplementary features such as navigation tools, illumination, or adaptability to different beverage containers.

Implementations of a versatile insulation and secure storage system may address some or all of the problems described above. A versatile insulation and secure storage system, for instance, could encompass features such as RFID shielding within card compartments, ensuring the protection of cards from unauthorized scanning. It may also include a combination of beverage holder and wallet, thus simplifying beverage transport and card organization in one versatile device, all the while preserving the temperature of the beverage, Additionally, this system could offer adaptability to various materials, allowing users to select materials that suit their preferences and needs, whether its plastic, neoprene, silicone, fabric, or leather.

The disclosed embodiments of this versatile insulation and secure storage system address the problems identified by offering a novel solution that streamlines daily routines and enhances user experiences. By integrating essential features like card security, beverage insulation, and adaptability, these embodiments provide a comprehensive and versatile system that meets the demands of modern users. This innovation optimizes the organization of cards, enhances security, simplifies beverage transport, provides effective beverage insulation, and opens doors for further customization, ultimately offering an all-in-one solution to a diverse range of user needs and preferences.

FIG. 1 illustrates a front view of a versatile insulation and secure storage system 100, showcasing a specific embodiment. FIG. 1 illustrates how the versatile insulation and secure storage system 100 integrates both beverage containment and wallet functionalities and provides a detailed view of various features of its various features. The versatile insulation and secure storage system 100 may serve as a beverage holder, with an insulated sleeve 110 configured to securely envelop a beverage container 105. The insulated sleeve 110 may encapsulate the beverage container 105 and provide thermal insulation to maintain the desired temperature of the beverage within the beverage container 105, be it hot or cold, in varying environmental conditions.

In addition, the versatile insulation and secure storage system 100 may comprise a first pocket 120. The placement and layout of the first pocket 120 may be readily visible and strategically positioned on the versatile insulation and secure storage system 100 for the secure vertical storage of a card, including a credit card, an identification card, or a driver's license. In another embodiment, the first pocket 120 may be positioned in a horizontally oriented manner, extending laterally along a portion of the system's width, where the first pocket 120 may be configured to hold the card horizontally. Modification may be made to the first pocket 120 without departing from the scope of the present invention. For example, instead of the first pocket 120, a plurality of pockets, may be integrated on the insulated sleeve 110, where each pocket may be configured to hold one card.

The versatile insulation and secure storage system 100 may comprise a second pocket 130 configured to accommodate a driver's license or another card, as well as money, including coins. The second pocket 130 may be strategically integrated into the system 100 and may provide a secure and convenient storage solution for an essential identification card or any similarly sized card. The second pocket 130 may be transparent, and its strategic location may enable quick and convenient access to critical identification documents. Furthermore, the second pocket 130 may be positioned on either side of the system 100 and may comprise an opening or slit 132. The opening or slit 132 may be conveniently located in the middle of the second pocket 130, thereby allowing users to place their finger over it or through it. The slit 132 may enable the seamless insertion and retrieval of their driver's license or ID, thereby improving the accessibility and practicality of the system 100.

The system 100 may comprise a fastener 135, which may serve the purpose of closing and securing the second pocket 130. The fastener 135 may effectively seal an interior of the second pocket 130. By doing so, the fastener 135 not only adds a layer of security but also prevents unauthorized access and potential damage to the contents stored within the second pocket 130, which may include vital identification cards or other valuable items. In this way, the fastener 135 may act as a safeguard, ensuring that the stored cards remain protected and readily accessible when needed.

As shown in FIG. 1, the fastener 135 may be positioned in a vertically oriented manner, extending longitudinally along a portion of the system's length. In this specific placement, the fastener 135 may run parallel to the side of the system 100. By aligning the fastener 135 vertically, it allows for a more natural and ergonomic grip when opening or closing the second pocket 130, such that users can easily secure and access their stored items, such as identification cards or driver's licenses, with minimal effort.

Figure 2:
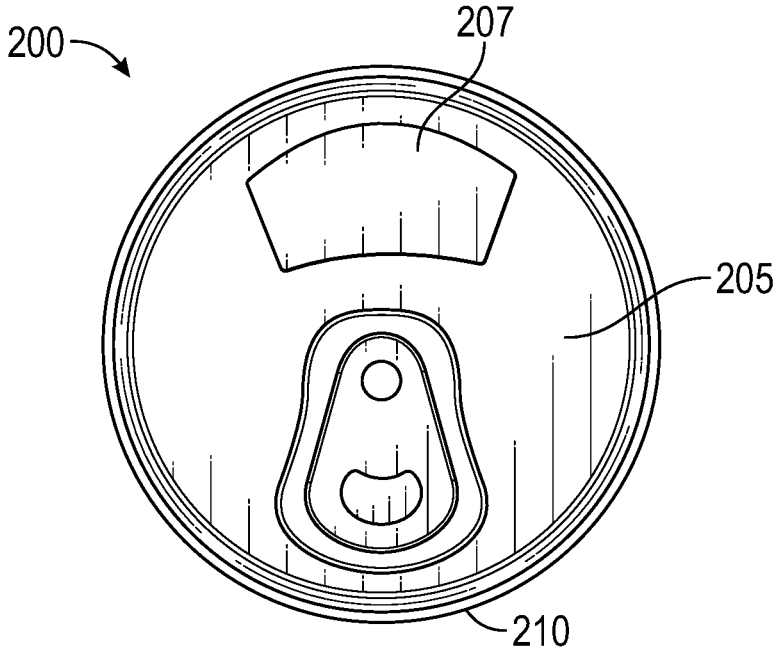
FIG. 2 illustrates a top-down view of a versatile insulation and secure storage system, according to an embodiment.

FIG. 2 illustrates a top-down view of a system 200, according to an embodiment. This figure demonstrates various components, including a beverage container 205 and an insulated sleeve 210. The insulated sleeve 210 may envelope the beverage container 205 and provide thermal insulation to maintain the desired temperature of the beverage within. This feature ensures the preservation of a cold drink on a hot summer day or the warmth of a hot beverage in chillier conditions. Effectively, the illustrated embodiment exemplifies the practicality and versatility of the system 200 which provides a solution that caters to the beverage needs of users in various weather conditions.

As shown in FIG. 2, a can is depicted as the beverage container 205, and a top of the container 205 may remain open and accessible for drinking or pouring without removing the container from the insulated sleeve 210. An opening 207 of the can may be accessible, allowing an individual to effortlessly sip or pour the beverage it contains. In this regard, users can enjoy their drinks without the need for additional tools or extensive effort. Furthermore, it will be appreciated that the system 200 may be adaptable to various types of drink containers. The versatility of the system 200 may allow a user to choose different container styles to suit their beverage preferences.

Figure 3:
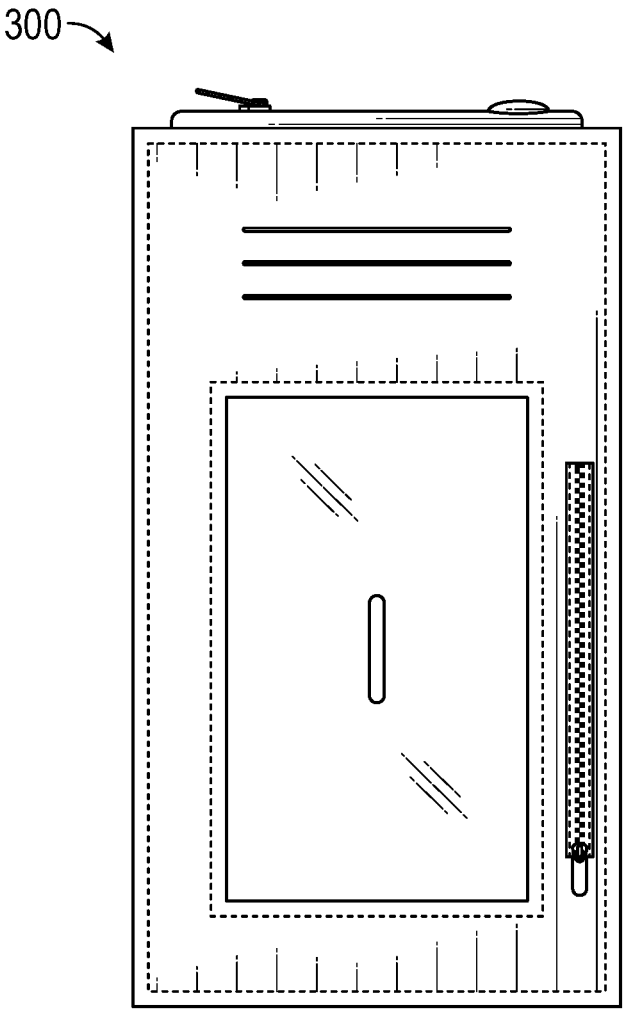
FIG. 3 illustrates a front view of a versatile insulation and secure storage system, according to an embodiment.

FIG. 3 illustrates a front view of a combination beverage holder and wallet, showcasing a specific embodiment. In this depiction, FIG. 3 presents a system 300 that closely resembles the one shown in FIG. 1, with one notable distinction: the absence of a fastener. The system in FIG. 3 provides an alternative embodiment, where the secure closure method provided by the fastener in the previous embodiment is omitted. This variation provides users with an alternative configuration, catering to those who prefer a closure mechanism other than a fastener, while still benefiting from the multifunctional features of the system 300.

Figure 4:
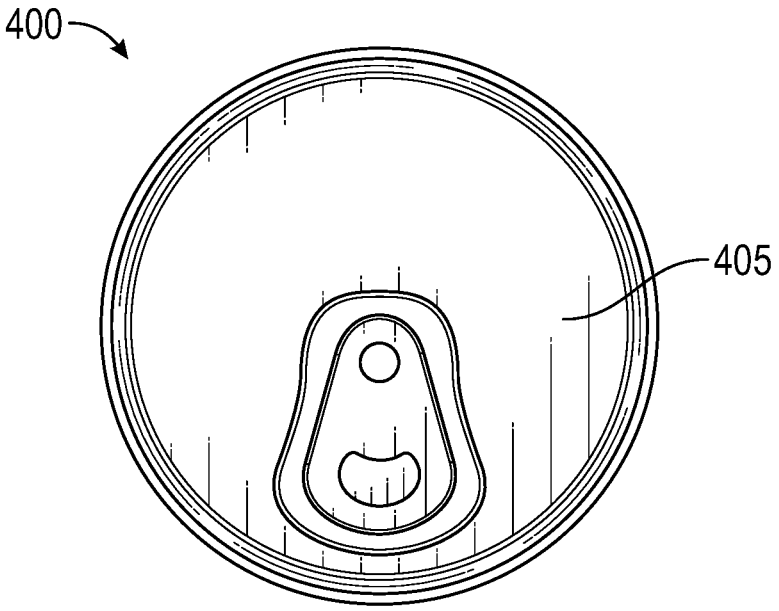
FIG. 4 illustrates a top-down view of a versatile insulation and secure storage system, according to an embodiment.

FIG. 4 illustrates a top-down view of a system 400, according to a specific embodiment. In this depiction, the system 400 closely resembles what is shown in FIG. 2. However, there is a notable distinction: rather than a container 405 containing a beverage, the container 405 holds food, such as soup or other consumables. This alternative embodiment shows the versatility of the system 400 and demonstrates its suitability for preserving the warmth and convenience of not only beverages but also food items in various scenarios.

Figure 5:
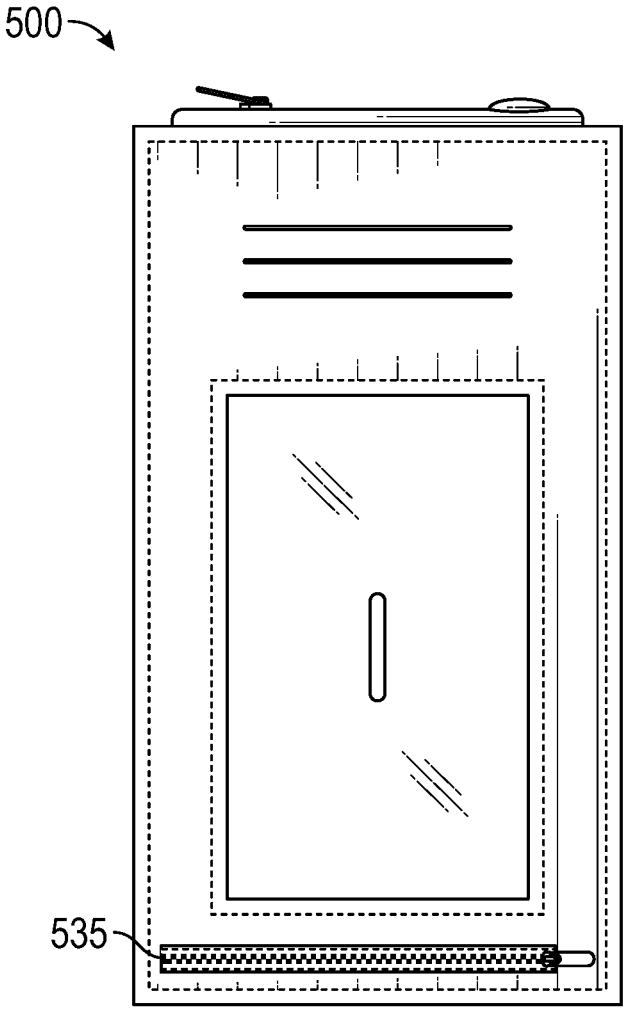
FIG. 5 illustrates a front view of a versatile insulation and secure storage system, according to an embodiment.

FIG. 5 presents a front view of a system 500, representing a specific embodiment. In this representation, the system 500 closely resembles what is depicted in FIG. 1, with a distinction, namely, the position of the fastener. In this embodiment, a fastener 535 may encircle a portion of the system 500. Particularly noteworthy is that the fastener 535 may be positioned near a bottom end of the system 500 and is positioned in a horizontally oriented manner, extending laterally along a portion of the system's width. This variation in the fastener's placement may provide an alternative method for accessing and securing the contents of the system 500, thereby catering to the preferences and convenience of users who may find this arrangement more suitable for their needs. Additionally, a horizontally oriented fastener, in particular, offers an advantage by distributing the fastening force evenly across the system, ensuring a secure closure, thereby preventing unintended openings and protecting essential items stored within the system.

Figure 6:
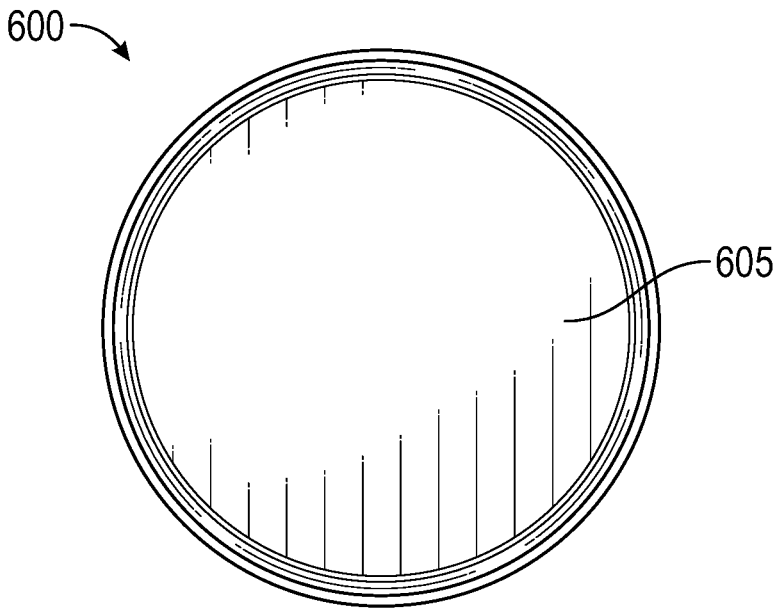
FIG. 6 illustrates a top-down view of a versatile insulation and secure storage system, according to an embodiment.

FIG. 6 provides a top-down view of a system 600, according to a specific embodiment. This representation closely resembles what is shown in FIGS. 2 and 4, with one notable difference. Instead of a beverage can, a container 605 in FIG. 6 may be configured to accommodate cosmetic containers that store beauty products, including items like perfumes, lotions, or serums, that can greatly benefit from temperature control to uphold their quality. This configuration showcases the versatility of the system 600 and demonstrates its ability to securely store and insulate various items, in this case, cosmetics.

Figure 7:
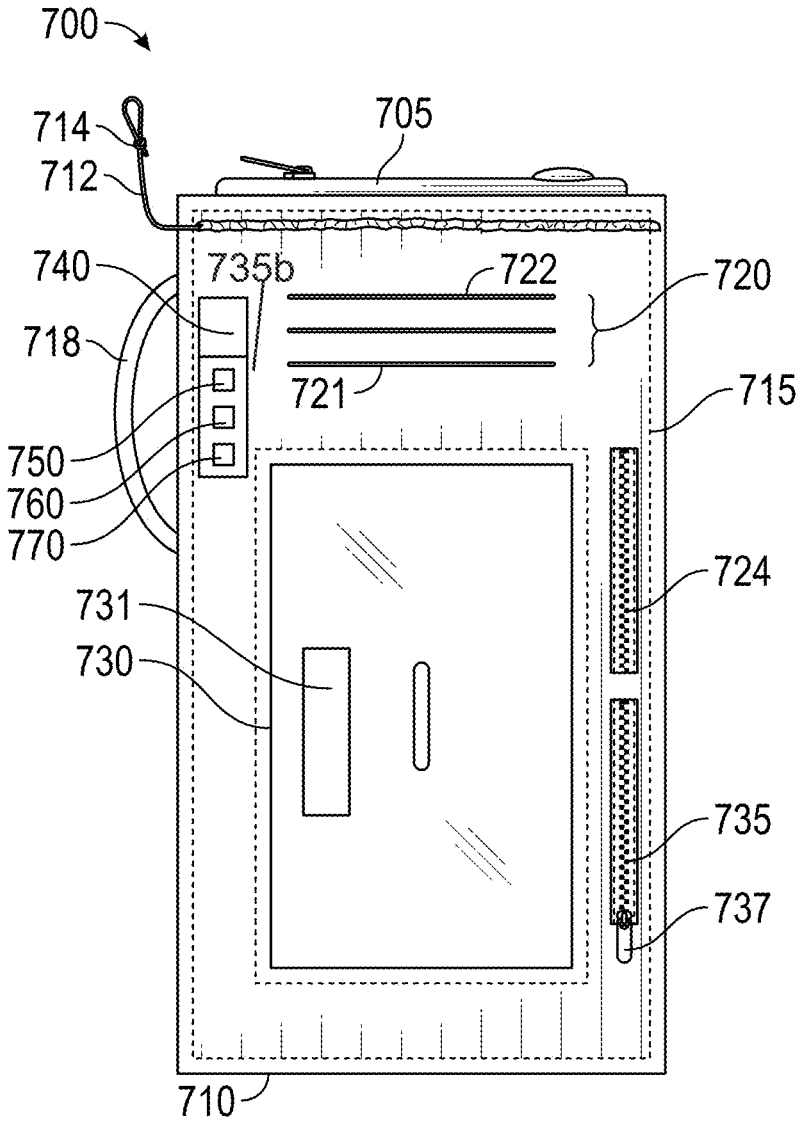
FIG. 7 illustrates a front view of a versatile insulation and secure storage system, according to an embodiment.

FIG. 7 illustrates a front view of a versatile insulation and secure storage system 700 for seamlessly integrating the functions of a beverage holder and wallet into a single, compact device, according to an embodiment. The versatile insulation and secure storage system 700 may simplify the way people carry their drinks and essential cards, such as identification or driver's licenses. Additionally, the versatile insulation and secure storage system 700 may be customizable design to fit different beverage containers, and potential incorporation of supplementary features to enhance its utility.

According to various embodiments, the system 700 may comprise an insulated sleeve 710 for surrounding a container 705 inserted therein, a first pocket 720 for holding a card 722 vertically within the insulated sleeve 710, and a second pocket 730 allowing users to keep their essential cards close at hand while enjoying the benefits of a beverage holder and additional features. Additionally, the system 700 may comprise a multifunctional device 740.

The insulated sleeve 710 of the system 700 may be configured to surround a portion of the container 705 inserted therein. For example, the sleeve 710 may encompass a substantial portion of the container 705, leaving a top portion of the container 705 exposed to allow access to its contents. In this regard, the insulated sleeve 710 may envelop and provide thermal insulation to the container 705 contained within, effectively maintaining a desired temperature of the container 705. In the case where the container 705 contains a beverage therein, the sleeve 710 may keep the beverage cold on a hot summer day or maintain the warmth of the hot beverage in colder conditions. Specifically, the insulated sleeve 710 may comprise an inner lining 715 made of a moisture-resistant material to protect the card 722 and contents from beverage condensation. In one embodiment, the insulated sleeve 710 may comprise a first fastener 724. The first fastener 724 may comprise an opening and closing component (not shown) that is configured to securely open and close the insulated sleeve 710, thereby enabling the insertion of the container 705 and ensuring effective thermal insulation within the system 700.

For example, in one embodiment, the first fastener 724 may comprise a zipper that may be used to close the insulated sleeve 710. The zipper may extend longitudinally along a portion of the sleeve's length, enabling a secure and adjustable closure that encompasses the container 705. In an alternative embodiment, the first fastener 724 may comprise a hook and loop fastener that may be used to close the insulated sleeve 710, where the insulated sleeve 710 is configured to overlap along its length, allowing for an adjustable and snug closure that tightly encases the container 705.

In another embodiment, the first fastener 724 may comprise an adjustable cord component 712 that functions similarly to the waistband of pants. One end of the cord 712 may be securely anchored near the top of the insulated sleeve 710, while the other end is equipped with a cord lock 714, which functions like a belt buckle. To tailor the fit for different container sizes, the user can simply pull the free end of the cord 712, which tightens the insulated sleeve 710 around the container 705, much like tightening a belt. Once the desired fit is achieved, the user can secure it in place by engaging the cord lock 714, which prevents any loosening. If the user needs to release or loosen the insulated sleeve 710, disengaging the cord lock 714 and gently pulling the cord 712 achieves this, similar to the act of loosening the waistband on a pair of pants.

The insulated sleeve 710 may be constructed from various materials, including plastic, neoprene, silicone, fabric, leather, or the like. In one embodiment, the insulated sleeve 710 may comprise a flexible material capable of expansion to accommodate various sizes of beverage containers. The choice of materials may be selected to ensure that the sleeve 710 not only preserves the beverage's temperature but also provides durability and ease of maintenance. Furthermore, in one embodiment, an adjustable strap 718 may be attached to the insulated sleeve 710 to facilitate carrying the combination beverage holder and wallet 700.

The first pocket 720 in the combination beverage holder and wallet 700 may be configured to securely accommodate and organize the card 722 in a vertical orientation within the insulated sleeve 710. The first pocket 720 may be integrated on the insulated sleeve 710 to provide easy access and efficient storage for credit cards, identification cards, driver's licenses, or any other similarly sized cards. The vertical orientation ensures that the card 722 can be effortlessly inserted and removed. Additionally, the first pocket 720 may incorporate RFID shielding technology 721 integrated therein, offering an added layer of security to protect the card 722 from potential unauthorized scanning or data theft. Furthermore, the first pocket 720 may be color-coded or labeled for easy card identification.

The second pocket 730 may be utilized for the secure storage of identification cards or driver's licenses. In one embodiment, the second pocket 730 may comprise a transparent material and may be strategically positioned on a side of the insulated sleeve 710, which may enable quick and easy access to these essential cards or documents without the need for extensive searching. In an alternative embodiment, the second pocket 730 may comprise a non-transparent material. The non-transparent material may conceal the sensitive information of the cards held within the second pocket 730, thereby adding an extra layer of privacy and protection.

Additionally, the second pocket 730 may comprise a second fastener 735 for secure closure. The fastener 735 may comprise a zipper, a snap closure, or a hook and loop fastener. Additionally, the fastener 735 may comprise a locking component 737. The locking component 737 may be configured to protect the identification card or driver's license by immobilizing the fastener 735. For example, once the second pocket 730 is attached to the insulating sleeve 710 using the second fastener 735, the locking component 737 may be activated to immobilize the fastener's movement, effectively locking the second fastener 725 in place, thereby preventing any unintentional or unauthorized opening of the second pocket 730.

The second pocket 730 may comprise a touch-sensitive screen 731 for displaying digital identification. The touch-sensitive screen 731 may provide a user-friendly interface for presenting various forms of identification, such as driver's licenses, ID cards, or digital wallet apps. Users can conveniently interact with the touch-sensitive screen 731 by swiping or tapping to access and display their identification. Additionally, the touch-sensitive screen 731 may be configured to adapt to different identification formats and sizes by using software that dynamically scales and formats the displayed digital identification to fit the screen size.

The multifunctional device 740 may be physically coupled to an outer surface of the insulated sleeve 710 by a second fastener **735*b*. The multifunctional device 730 may, however, be physically coupled to any suitable location on the system 700. For example, in an alternative embodiment, the multifunctional device 730 may be physically connected to a bottom end of the system 700. Specifically, the multifunctional device 740 may be detachably coupled to the outer surface of the insulated sleeve 710 using a snap button for easy attachment and removal. The multifunctional device 740 may comprise a versatile and adaptable tool designed to serve various purposes beyond its primary function. For instance, the multifunctional tool 740 may comprise various integrated components, such as a flashlight 750, a GPS 760, or a compass 770 for providing a user with additional utility and convenience to the traditional beverage holder and wallet 100. The flashlight 750 may provide portable illumination, serving as a useful source of light in low-light conditions or emergencies. Additionally, the flashlight 750 may comprise adjustable brightness settings for enhanced user convenience. The GPS 760 may enable users to determine their precise location and navigate effectively, which can be particularly useful during outdoor activities or when traveling. The compass 770 may aid in orientation and direction-finding. By combining these supplementary features into a single device, the multifunctional device 740** may provide a versatile tool for individuals seeking a compact and multifaceted solution for their everyday and outdoor needs A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently, Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The hounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A system, comprising:

a containment component comprising:

an insulated sleeve configured to surround and thermally insulate a container;

a first pocket integrally formed with the insulated sleeve;

a second pocket attached to the insulated sleeve;

a first fastener configured to open and close the insulated sleeve;

a second fastener configured to open and close the second pocket;

a permanent mounting receptacle affixed to an outer surface of the insulated sleeve; and wherein the insulated sleeve comprises a flexible material capable of expansion to accommodate various container sizes; and a functional component comprising:

a housing configured as a unitary assembly;

a plurality of integrated elements comprising a flashlight, GPS tracking device, and compass arranged in a fixed spatial relationship within the housing;

a snap connection mechanism protruding from a base portion of the housing configured to selectively engage with the mounting receptacle of the containment component;

wherein the functional component maintains operational access to all integrated elements when attached to the containment component;

and wherein the functional component is configured to maintain functionality independent of attachment to the containment component.

2. The system of claim 1, wherein the second pocket comprises RFID shielding to protect the identification card or driver's license from unauthorized scanning.

3. The system of claim 1, further comprising an adjustable strap attached to the insulated sleeve for carrying the apparatus.

4. The system of claim 1, wherein the second pocket comprises a centrally located opening or slit configured for a user to place their finger over or through it, allowing seamless insertion and retrieval of the identification card or driver's license.

5. The system of claim 1, wherein the second fastener comprises an integrated sliding lock mechanism having a first portion fixed to the second pocket and a second portion slidably mounted on the fastener, the second portion configured to engage with the first portion in a locked position to immobilize movement of the fastener relative to the second pocket while maintaining the second pocket in a closed configuration, wherein the sliding lock mechanism is permanently affixed to and moves with the fastener during opening and closing operations.

6. The system of claim 1, wherein the insulated sleeve comprises an inner lining constructed from a moisture-resistant material, and wherein the inner lining forms a protective barrier to protect the identification card or driver's license against beverage condensation or moisture.

7. The system of claim 1, wherein the second pocket comprises a touch-sensitive screen assembly, comprising:

a flexible display panel integrally bonded to an inner surface of the second pocket;

a temperature-compensating control circuit configured to adjust display parameters based on thermal feedback from the insulated sleeve; and an adaptive display controller configured to automatically adjust displayed digital identification formats while maintaining display clarity under varying thermal conditions from the container.

8. The system of claim 1, wherein the insulated sleeve comprises plastic, neoprene, silicone, fabric, or leather.

9. A system, comprising:

configuring a base unit by the steps of:

providing a container-receiving volume within an insulated sleeve;

integrating a first pocket into the insulated sleeve;

attaching a second pocket to the insulated sleeve;

affixing a permanent mounting receptacle to an outer surface of the insulated sleeve;

securing fasteners to the insulated sleeve for selectively accessing the pockets; and selecting a flexible material for the insulated sleeve to accommodate various container sizes; and a combined container and functional device comprising:

a unitary housing containing functional elements further comprising:

a flashlight;

a GPS tracking device; and a compass;

wherein the functional elements are arranged in fixed spatial relationship;

a snap connection mechanism protruding from a base portion;

wherein the snap connection mechanism is configured to selectively engage the sleeve;

wherein the functional elements maintain operational access when the housing is attached; and wherein the housing maintains independent functionality when detached.

10. The system of claim 9, wherein the first pocket is positioned in a horizontally oriented manner, extending laterally along a portion of a width of the apparatus, and wherein the pocket is configured to hold the first card horizontally.

11. The system of claim 9, wherein the second pocket comprises a non-transparent material, and wherein the second pocket effectively conceals various sensitive information of the second card held within the second pocket.

12. The system of claim 9, wherein the fastener is positioned in a vertically oriented manner, extending longitudinally along a portion of a length of the apparatus, and wherein the vertically oriented fastener allows for a more natural and ergonomic grip when opening or closing the second pocket.

13. The system of claim 9, wherein the fastener is positioned in a horizontally oriented manner, extending laterally along a portion of a width of the apparatus, and wherein the horizontally oriented fastener distributes a fastening force evenly across the second pocket to prevent an unintended opening of the second pocket.

14. The system of claim 9, wherein the container comprises a beverage can, food can, or a cosmetic container.

15. A method, comprising:

inserting a container into an insulated sleeve configured to envelop and provide thermal insulation to the container, thereby effectively maintaining a desired temperature of the container;

placing a first card vertically within a first pocket integrated with the insulated sleeve;

inserting a second card into a second pocket attached to the insulated sleeve and securely closing the second pocket using a fastener;

mounting a unitary multifunctional device to an outer surface of the insulated sleeve by:

aligning a snap button coupling protruding from a base portion of the multifunctional device with a corresponding receptacle permanently affixed to the outer surface of the insulated sleeve and pressing the snap button coupling into engagement with the receptacle, wherein:

the unitary multifunctional device comprises a housing containing integrally formed functional components, wherein the functional components comprise:

a flashlight, a GPS tracking device, and a compass;

the functional components are arranged in a fixed spatial relationship relative to each other.

16. The method of claim 15, further comprising modifying the insulated sleeve to adapt to containers of varying sizes using an integrated adjustable cord with a tightening and loosening component, wherein the adjustable cord securely attaches at a top end of the sleeve and comprises a cord lock, wherein a user can adjust a fit by pulling the cord's free end for tightening and engaging the cord lock to a desired position.

17. The method of claim 15, wherein the multifunctional device is detachably coupled to the outer surface of the insulated sleeve using a snap button.

18. The method of claim 15, wherein the insulated sleeve is closed using a fastener to form a thermally insulated enclosure around the container, while keeping a top of the container open and accessible for drinking or pouring without removing the container from the insulated sleeve.

* * * * *